US010392218B2

(12) United States Patent
Barnes

(10) Patent No.: US 10,392,218 B2
(45) **Date of Patent: *Aug. 27, 2019**

(54) ENDLESS BELT FLEXIBLE TUBE CLEANING LANCE DRIVE APPARATUS

(71) Applicant: STONEAGE, INC., Durango, CO (US)

(72) Inventor: Jeffery R. Barnes, Ignacio, CO (US)

(73) Assignee: STONEAGE, INC., Durango, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/869,837

(22) Filed: Jan. 12, 2018

(65) Prior Publication Data

US 2018/0134511 A1 May 17, 2018

Related U.S. Application Data

(63) Continuation of application No. 15/495,516, filed on Apr. 24, 2017, now Pat. No. 9,896,299.
(Continued)

(51) Int. Cl.
*B65H 51/10* (2006.01)
*B65H 51/14* (2006.01)
(Continued)

(52) U.S. Cl.
CPC ..... *B65H 51/105* (2013.01); *B08B 9/0433* (2013.01); *B65H 51/14* (2013.01);
(Continued)

(58) Field of Classification Search
CPC ..... B65H 51/04; B65H 51/105; B65H 51/10; B65H 51/14; B65H 51/08; F28G 15/04; B65G 2812/018; B65G 15/16
See application file for complete search history.

(56) References Cited

U.S. PATENT DOCUMENTS 3,468,409 A 9/1969 Ball
3,817,262 A 6/1974 Caradeur et al.
(Continued)

FOREIGN PATENT DOCUMENTS

EP 1316381 6/2003

OTHER PUBLICATIONS

International Search Report and Written Opinion, dated Jul. 14, 2017, from corresponding International Patent Application No. PCT/US2017/029128.

*Primary Examiner* — Michael C McCullough
(74) *Attorney, Agent, or Firm* — Greenberg Traurig, LLP; John Wahl

(57) ABSTRACT

A flexible lance drive device has at least one drive motor in a first portion of a housing and a drive axle projecting across a second portion of the housing carrying a cylindrical spline drive roller. A plurality of cylindrical guide rollers on fixed axles span across the second portion of the housing aligned parallel to the spline drive roller. An endless belt wrapped around the at least one spline drive roller and guide rollers has a generally smooth outer surface and a transverse splined inner surface having splines shaped complementary to splines on the spline drive roller. A bias member supports a plurality of follower rollers each aligned vertically above one of the at least one spline drive roller and guide rollers operable to press each follower roller toward one of rollers to frictionally grip a flexible lance hose when sandwiched between the follower rollers and the endless belt.

20 Claims, 7 Drawing Sheets

Related U.S. Application Data

(60) Provisional application No. 62/332,309, filed on May 5, 2016.

(51) Int. Cl.

| | |
|---|---|
| ***F28G 15/04*** | (2006.01) |
| ***F28G 15/02*** | (2006.01) |
| ***B08B 9/043*** | (2006.01) |
| *F28G 1/16* | (2006.01) |

(52) U.S. Cl.
CPC ..... *F28G 15/02* (2013.01); *F28G 15/04* (2013.01); *B65H 2701/33* (2013.01); *B65H 2701/39* (2013.01); *F28G 1/163* (2013.01)

(56) References Cited

U.S. PATENT DOCUMENTS

| | | | |
|---|---|---|---|
| 3,938,535 | A | 2/1976 | Cradeur et al. |
| 4,000,636 | A | 1/1977 | Shubin et al. |
| 4,817,845 | A | 4/1989 | Franchuk |
| 5,109,598 | A | 5/1992 | Koch |
| 5,397,057 | A | 3/1995 | Verstraeten |
| 5,692,859 | A | 12/1997 | Dickson et al. |
| 6,484,920 | B1 | 11/2002 | Selcer |
| 6,757,932 | B1 | 7/2004 | Verstraeten |
| 7,086,353 | B2 | 8/2006 | Hwang et al. |
| 2010/0300498 | A1 | 12/2010 | Wojciechowski, III et al. |
| 2015/0034128 | A1 | 2/2015 | Brumfield |
| 2016/0052029 | A1 | 2/2016 | Moll et al. |

ENDLESS BELT FLEXIBLE TUBE CLEANING LANCE DRIVE APPARATUS

CROSS REFERENCE TO RELATED APPLICATIONS

This application is a continuation of U.S. patent application Ser. No. 15/495,516, filed Apr. 24, 2017, having the same title, which claims the benefit of priority of U.S. Provisional Patent Application No. 62/332,309, filed May 5, 2016, entitled Endless Belt Flexible Tube Cleaning Lance Drive Apparatus, the contents of which are incorporated by reference herein in their entirety.

BACKGROUND OF THE DISCLOSURE

The present disclosure is directed to high pressure fluid cleaning lance handling systems. In particular, embodiments of the present disclosure are directed to an apparatus for advancing and retracting one or more flexible tube cleaning lances from tubes arranged in an array, such as in a heat exchanger, from a position adjacent a heat exchanger tube sheet.

A flexible lance drive apparatus typically includes a drive motor coupled via gearing, a chain, or a belt to one or more drive mechanisms. Drive mechanisms can be rollers that are arranged in pairs or sets sandwiching a flexible lance hose therebetween or chain and block assemblies oriented with interlocking top and bottom assemblies. At least one roller of the sets of rollers, or chain and block assemblies may be driven. In order to accommodate different diameter lance hoses, the rollers or chain and block assemblies must be laboriously disassembled and replaced, and it may be necessary to modify the drive motor as well to accommodate the characteristics of a different driven lance hose. Additionally, once a mechanism has been properly configured for a given lance hose size, the distance between opposing drive mechanism roller pairs as the force that a given pair exerts on a lance hose is typically adjusted via a manual mechanical adjustment.

U.S. Pat. No. 9,070,830, for example, teaches a drive apparatus which requires the lance itself to be bent around a portion of the drive wheel in order to ensure sufficient drive force is transferred to the lance itself, especially in real world environmental application scenarios which are often less than ideal. Furthermore, such drive apparatuses are large, bulky, and thus must be either separately located on a floor near the heat exchanger tube sheet into which the lance or lances are supposed to be guided, as is shown in that publication, or rigidly mounted to a tray spaced from and aligned with the tube sheet. In such cases the tube bundle is typically physically removed from the heat exchanger and placed in an environment with sufficient space to accommodate the tray and drive assembly.

A lance drive mechanism incorporating a pair of opposing endless belts is disclosed in US Patent Application Publication 2010/0300498. This apparatus includes two opposing, segmented, endless belts above and below a flexible lance. Each of the belts has a V shaped groove in which the lance being driven resides. A pair of opposing platform clamps are used to push the endless belts against the lance(s) in the V shaped grooves of the belt. This generates a substantial drag on the endless belt that must be overcome by the power of the drive motor or motors.

What is therefore needed is a compact package drive solution that takes up a minimal space, can be mounted directly to an x-y lance positioner, facilitates simplified handling of multiple lances and several different sized flexible lance hoses interchangeably, can operate consistently under a variety of operating conditions, can be optimized for performance remotely, and remains simple to repair, service and modify for a variety of applications.

SUMMARY OF THE DISCLOSURE

A flexible lance drive apparatus or device in accordance with the present disclosure directly addresses such needs. An exemplary embodiment of a flexible lance drive apparatus includes a housing, at least one pneumatic drive motor disposed in a first portion of the housing having a drive axle projecting across a second portion of the housing carrying a cylindrical spline drive roller, a plurality of cylindrical guide rollers on fixed axles spanning across the second portion of the housing aligned parallel to the spline drive roller, a side surface of each guide roller and the at least one spline drive roller being tangent to a common plane between the rollers, and an endless belt wrapped around the at least one spline drive roller and guide rollers. The belt has a generally smooth outer surface and a transverse splined inner surface having splines shaped complementary to splines on the spline drive roller. A bias member supports a plurality of follower rollers each aligned vertically above one of the at least one spline drive roller and guide rollers. The bias member is operable to press each follower roller toward one of the spline drive rollers and guide rollers to frictionally grip a flexible lance hose when sandwiched between the follower rollers and the endless belt.

An exemplary embodiment of a flexible lance drive apparatus in accordance with the present disclosure includes a generally rectangular housing and a first and a second drive motor disposed side by side and spaced apart in a first portion of the housing. Each drive motor has a drive axle projecting into a second portion of the housing carrying a cylindrical spline drive roller. A plurality of cylindrical guide rollers on fixed axles span across the second portion of the housing between the spline drive rollers and are aligned parallel to the spline rollers. An endless belt having an inner spline side and an outer side is wrapped over the drive rollers and guide rollers. The side surface of each guide roller is tangent to an axis tangent to and extending between the spline rollers. A bias member supporting a plurality of follower rollers is aligned vertically above the spline drive rollers and guide rollers. This bias member is operable to presses each follower roller against a flexible lance hose sandwiched between the follower rollers and the endless belt on the spline rollers as the endless belt is rotated to frictionally propel the lance hose forward and backward through the apparatus.

Further features, advantages and characteristics of the embodiments of this disclosure will be apparent from reading the following detailed description when taken in conjunction with the drawing figures.

DETAILED DESCRIPTION

Figure 1:
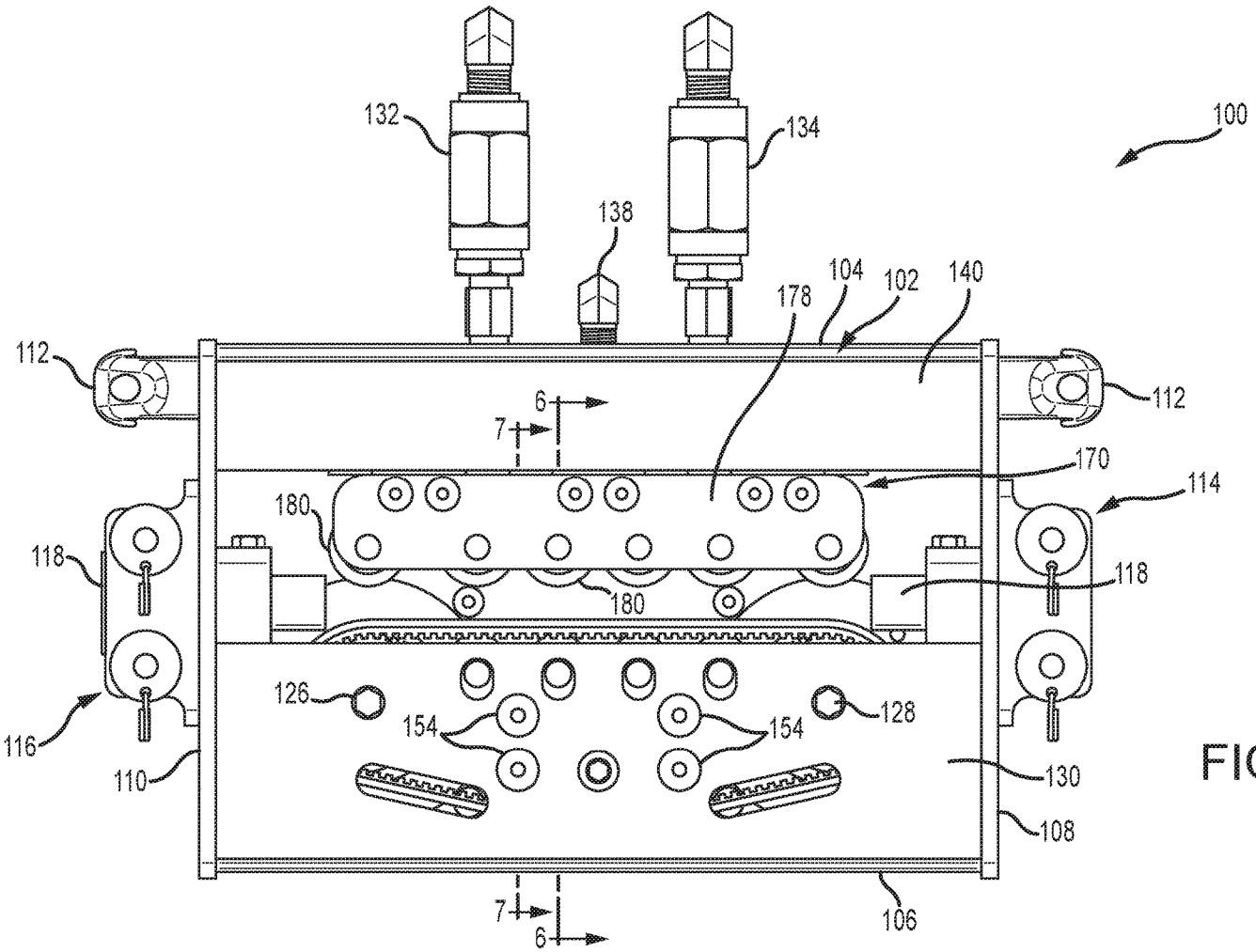
FIG. 1 is a belt side view of the drive apparatus in accordance with the present disclosure.

An exemplary high pressure cleaning lance hose drive apparatus according to the present disclosure is shown in FIGS. 1-7. Referring now to FIG. 1, a belt side view of the apparatus 100 is shown with its side cover removed. The apparatus 100 has a rectangular box housing 102 that includes a flat top plate 104, a bottom plate 106, front and rear walls 108 and 110, and two C shaped carry handles 112, one on each of the front and rear walls 108 and 110. In FIGS. 1-7, sheet side covers (not shown) are removed so that internal components of the apparatus 100 are visible.

Fastened to the front wall 108 is an exit hose guide manifold 114. Fastened to the rear wall 110 below the carry handle 112 is a hose entrance guide manifold 116. Each of these manifolds 114 and 116 includes a set of hose guide collets 118 for guiding one to three flexible lance hoses (not shown) into and out of the housing 102. Each guide collet set 118 is sized to accommodate a particular lance hose diameter. Hence the collet sets are changeable depending on the lance size to be driven by the apparatus 100.

Figure 2:
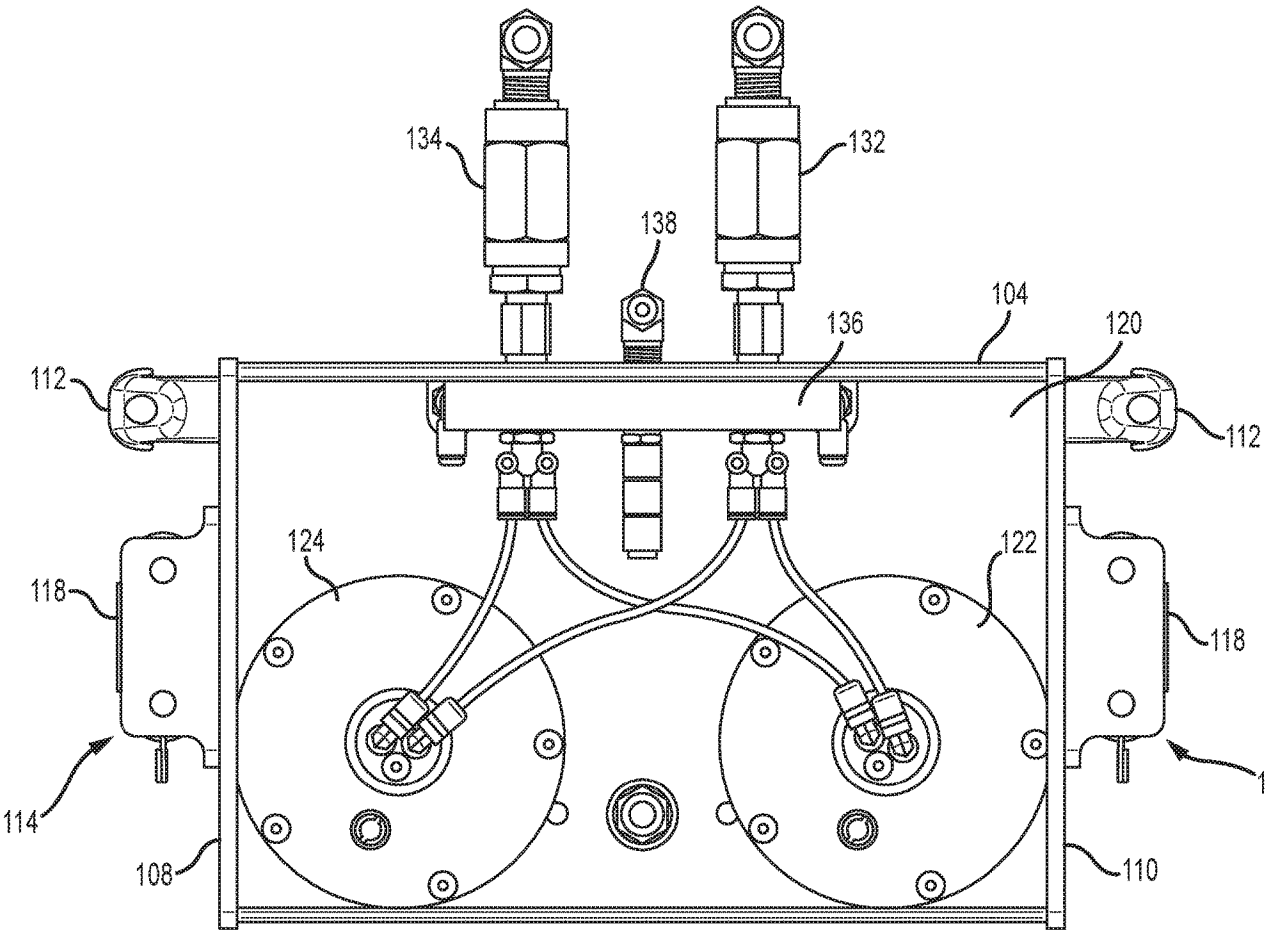
FIG. 2 is a drive motor side view of the drive apparatus in accordance with the present disclosure.

A motor side view of the apparatus 100 is shown in FIG. 2. The housing 102 includes an inner vertical support partition wall 120 fastened to the front and rear walls 108 and 110 and the top and bottom plates 104 and 106. This vertical support partition wall 120 divides the housing into a first portion and a second portion. The first portion houses hose fittings and drive motors. The second portion is a belt cavity 121 through which flexible lance hoses are driven, and is shown at least in FIGS. 1, 3 and 4.

Figure 3:
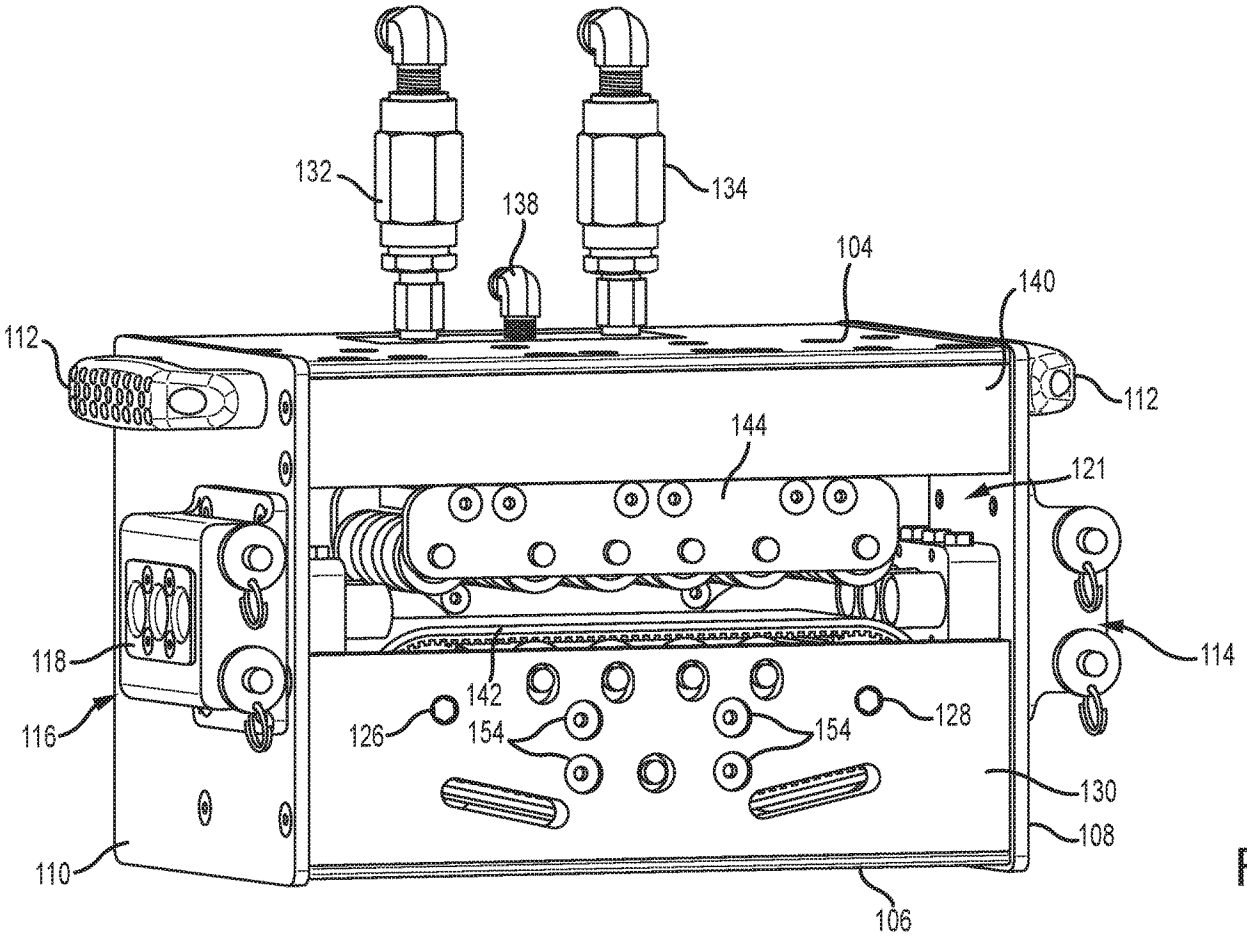
FIG. 3 is a belt side perspective view of the drive apparatus in accordance with the present disclosure with its side cover removed.

In this exemplary embodiment 100, the inner vertical support wall 120 carries a pair of pneumatic drive motors 122 and 124 mounted such that their drive shafts 126 and 128 protrude laterally through the support wall 120 into the second portion, or belt cavity, between the inner vertical wall 120 and an outer vertical lower support wall 130, shown in FIGS. 1 and 3. Each of the drive motors 122 and 124 is connected to pneumatic forward feed line 132 and reverse feed line 134 through a feed manifold 136 fastened to the top plate 104. A clamp pressure feed line fitting 138 also passes through this feed manifold 136 to a hose clamp assembly 144 described below. Each of the drive motors 122 and 124 is preferably a compact radial piston pneumatic motor. However, hydraulic or electric motors could alternatively be used.

On the belt side view shown in FIGS. 1 and 3, the belt cavity 121 is defined between the inner vertical wall 120 and the outer lower support wall 130. A separate upper outer support wall 140 aligned with the lower outer support wall 130 provides a rigid joint between the front and rear walls 108 and 110 while providing a visible space between the entrance and exit guide manifolds 116 and 114. This spacing helps an operator thread up to three lances laterally into and through the belt cavity 121 between an endless drive belt 142 and a vertically arranged hose clamp assembly 144. Each of the support walls 120, 130 and 140 is preferable a flat plate of a lightweight material such as aluminum or could be made of a structural polymer with sufficient strength and rigidity to handle the motor operational stresses involved.

Figure 4:
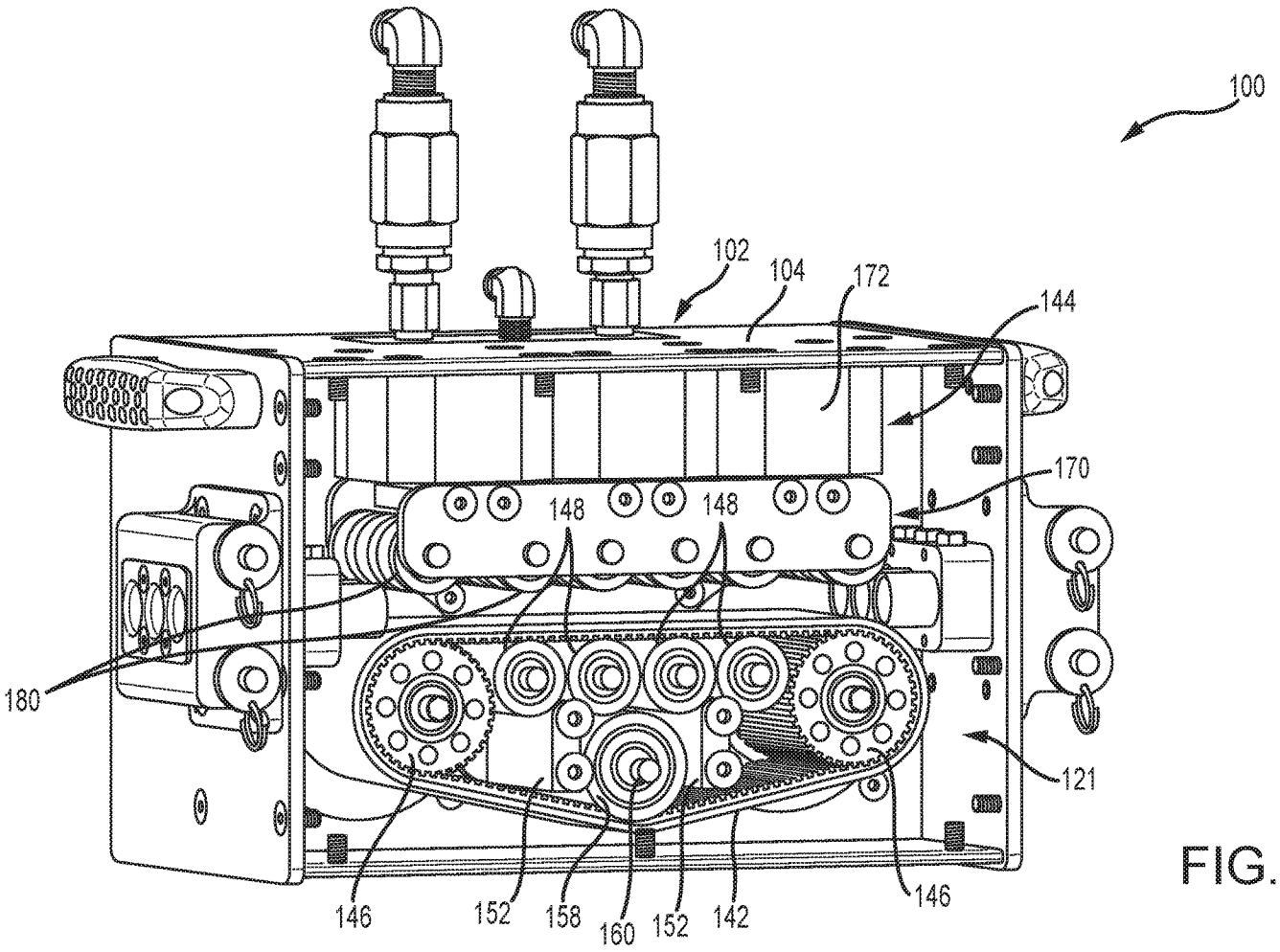
FIG. 4 is a belt side perspective view as in FIG. 3 with the upper and lower vertical support plates removed.
Figure 5:
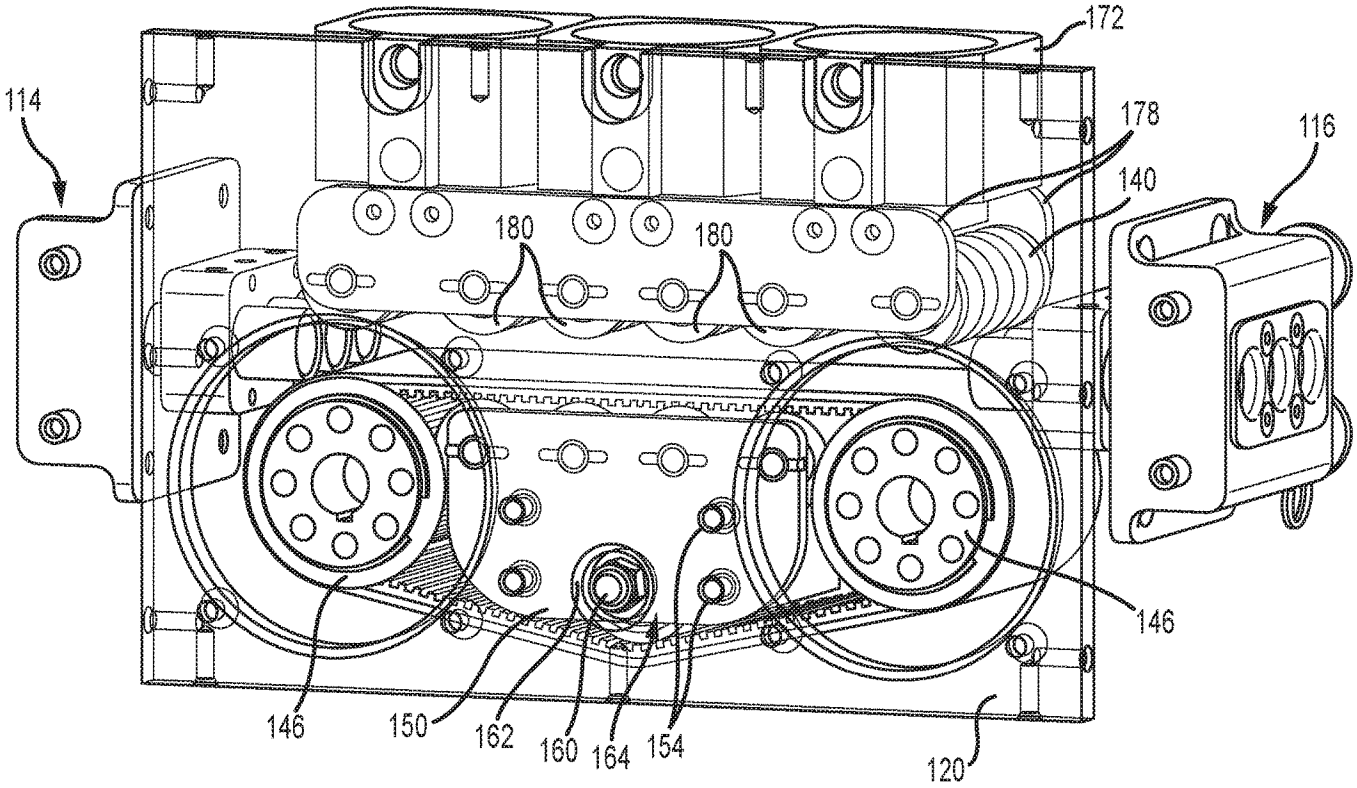
FIG. 5 is a drive motor side perspective view of the drive apparatus shown in FIGS. 1 and 2 with the housing top plate, bottom plate, and end plates removed and the first vertical support plate shown transparent.

A perspective view of the apparatus 100 with the upper and lower outer vertical support walls 140 and 130 removed is shown in FIG. 4. Each of the motor drive shafts 126 and 128 has an axial keyway fitted with a complementary key (not shown) that engages a corresponding keyway in a cylindrical splined drive roller 146. Thus each drive roller 146 is slipped onto and keyed to the drive shaft so as to rotate with the drive shaft 126 or 128. Each splined drive roller 146 has its outer cylindrical surface covered with equally spaced splines extending parallel to a central axis of the roller 146. The distal ends of each of the drive shafts 126 and 128 extends through the lower outer support wall 130 and are primarily laterally supported from plate 120. Additional lateral support for the distal ends of each of the drive shafts 126 and 128 is provided by the lower outer support wall 130 via cone point set screws engaging a V groove (not shown) in each of the shafts 126 and 128.

Each of the drive shafts 126 and 128 may extend fully through the splined drive rollers 146 or the drive motors 122 and 124 may each be fitted with a stub drive shaft which fits into a bearing within the proximal end of each of the splined drive rollers 146. A separate bearing supported drive shaft 126 or 128 extends out of the distal end of each drive roller 146 and is fastened to the support wall 130 via cone point set screws. In such an alternative, the drive rollers 146 become part of the drive shafts 126 and 128.

Spaced between the two splined drive rollers 146 is a set of four cylindrical guide rollers 148 that are supported by the lower outer support wall 130 via a vertical plate 150 and a pair of rectangular vertical spacer blocks 152 that are through bolted to both the lower outer support wall 130 and inner vertical wall 120 through the vertical plate 150 via bolts 154. This preferred bolting arrangement is shown in the sectional view of FIG. 7. While the bolts 154 pass through the vertical plate 150, their distal ends extend further through, and are threaded into holes 156 through the inner vertical wall 120.

Tension on the endless belt 142 is preferably provided by a tensioner roller 158 between the spacer blocks 152 that is supported from the inner vertical plate 150 on an eccentric shaft 160, and accessed through an opening 162 in the inner vertical wall 120, shown in FIG. 2. Rotation of this eccentric shaft 160 essentially moves the tensioner roller 158 through a slight arc downward or upward to provide more or less tension on the belt 142.

To replace the belt 142, the four bolts 154 are loosened and screws holding the outer lower wall 130 to the front and rear walls 108 and 110 are removed. The cone point set screws engaging a V groove (not shown) in each of the shafts 126 and 128 are then removed. The assembled structure including the vertical plate 150, spacer blocks 152, belt 142, drive rollers 146, and guide rollers 148 can then be removed as a unit by sliding the drive rollers 146 off of the keyed shafts 126 and 128.

In an alternative configuration if the bolts 154 are instead threaded into the plate 150 rather than the wall 120, and simply guided through holes 156 in wall 120, the outer lower wall 130, inner vertical plate 150, tensioner roller 158 on eccentric shaft 160 and spacer blocks 152 can form a unitary assembly 164 carrying the guide rollers 148 that can be separately removed laterally from the belt cavity as a unit by unfastening the outer lower wall 130 from the front and rear walls 108 and 110 and removing set screws from the drive rollers 146. When this unitary assembly 164 is removed, only the belt 142 and drive rollers 146 on shafts 126 and 128 remain in the belt cavity. The endless belt 142 may then be slipped easily off of the drive rollers 146 and a new belt 142 installed.

The assembly 164 including outer lower wall 130, inner vertical plate 150, tensioner roller 158 and spacer blocks 152 is then reinstalled between the end walls 108 and 110. The distal ends of the bolts 154 guide reassembly by registering with holes 156 in the inner vertical wall 120. The tensioner roller 158 may then be readjusted to provide proper belt tension through the opening 162 through the inner vertical wall 120.

Each of the splined drive rollers 146 preferably has equally spaced alternating spline ridges and grooves around its outer surface which are rounded at transition corners so as to facilitate engagement of the complementary shaped lateral spline ridges and grooves in the inner side or surface of the endless belt 142. Elimination of sharp transitions at both ridge corners and groove corners lengthens belt life while ensuring proper grip between the rollers and the belt. The outer surface portion or cover of the endless belt 142 is preferably flat and smooth to prevent undesirable hose abrasion and degradation and is preferably formed of a suitable friction material such as polyurethane. The inner side portion of the belt 142 is preferably a harder durometer polyurethane material bonded to the outer side cover. For applications with significant hydrocarbons or high lubricity products, grooves machined across the cover at 90° to the direction of belt travel may be utilized for improved traction performance against the flexible lance hose.

Spaced above the belt 142 in the belt cavity is a lance hose clamp assembly 144 including an idler roller assembly 170. This exemplary clamp assembly 144 includes a multi-cylinder frame 172 fastened to the top plate 104 of the housing 102. The multi-cylinder frame 172 carries two or three single acting pneumatic cylinders with pistons 174 that are each connected to a carrier block 176 and connected together via a pair of parallel spaced idler carrier frame rails 178. A set of six idler rollers 180 is carried by the frame rails 178, each vertically positioned directly above either one of the drive rollers 146 or one of the guide rollers 148. Each piston 174 may be spring biased such that without pneumatic pressure, the pistons 174 are all withdrawn or retracted fully into the multi-cylinder frame 172 so as to provide access space between the idler rollers 180 and the drive belt 142 for insertion and removal of flexible lance hoses.

Figure 6:
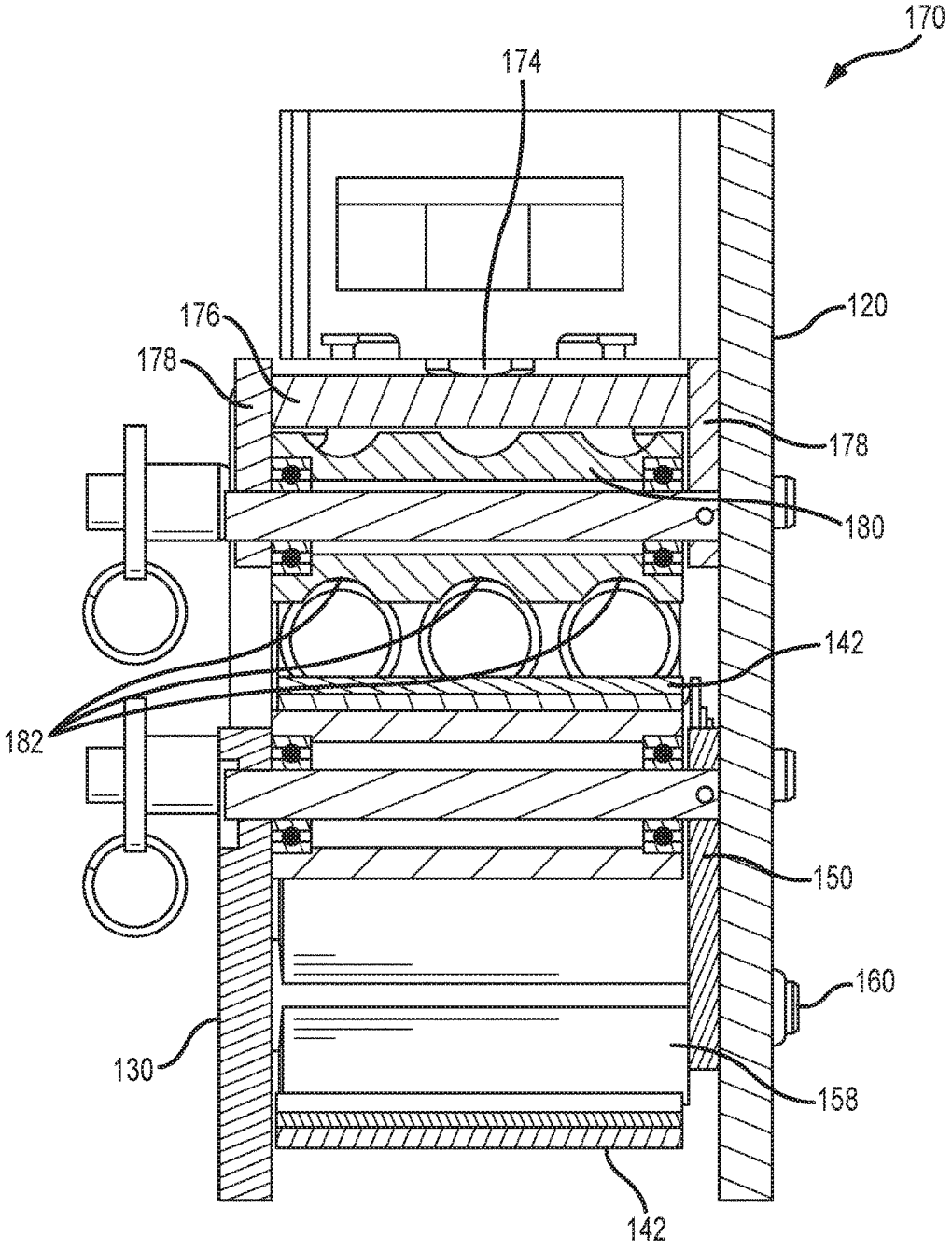
FIG. 6 is a vertical sectional view taken along the line 6-6 through the apparatus shown in FIG. 1.
Figure 7:
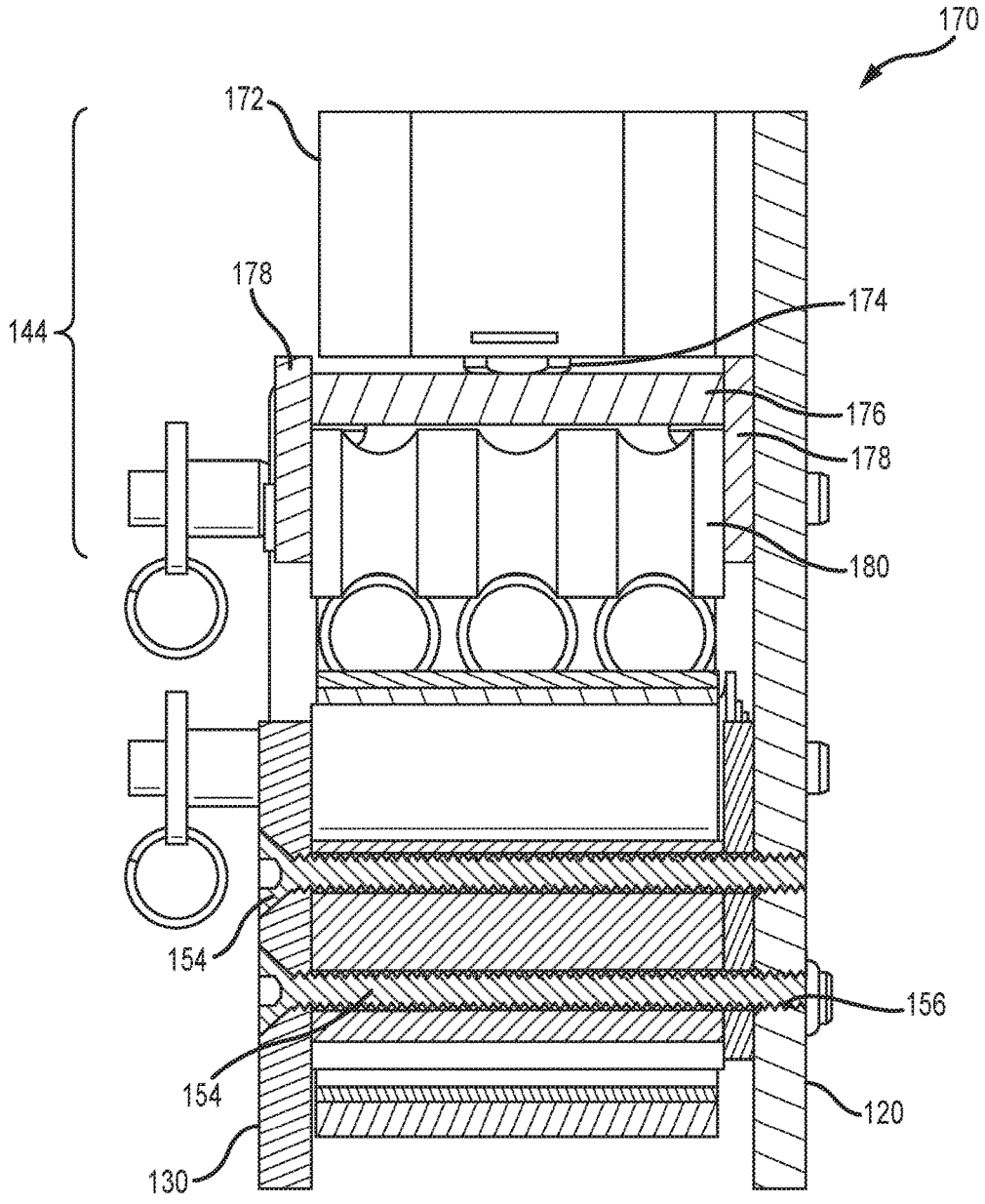
FIG. 7 is a vertical sectional view taken along the line 7-7 through the apparatus shown in FIG. 1.

The idler rollers 180 are best shown in the sectional views through the apparatus 100 shown in FIGS. 6 and 7. Each idler roller 180 is a bearing supported cylindrical body, preferably of aluminum, having three spaced annular grooves 182 each preferably sized complementary to the anticipated lance hose size. These annular grooves may be V shaped, semicircular, partial trapezoidal, rectangular, or smooth U shaped so as to provide a guide through the apparatus 100 and keep the flexible lance in desired contact with the endless belt 142 during transit. Preferably the idler rollers 180 are made of aluminum or other lightweight material capable of withstanding bending loads and each groove has a concave arcuate, preferably semicircular cross sectional shape. Each groove may alternatively be a rectangular slot with corners having a radius profile to allow the hoses to have limited lateral movement as they are fed through the apparatus 100.

In use, the drive apparatus 100 may be utilized with one, two, or three flexible lances simultaneously. In the case of driving one lance, such a lance would be preferably fed through the center collet and beneath the center groove of the idler rollers 180. When two lances are to be driven, the inner and outer collets 118 would be used. If three lances are to be driven, one would be fed through each collet and corresponding groove of each idler roller 180.

In alternative embodiments, more than three lance drive paths may be provided such as 2, 4 or five. Electrical or hydraulic actuators and motors may be used in place of the pneumatic motors shown and described. Although a toothed or spline endless belt is preferred as described and shown above, alternatively a smooth belt or grooved belt with wider spline spacing could be substituted along with appropriately configured drive rollers. The guide rollers 148 are shown as being smooth cylindrical rollers. They may alternatively be splined rollers similar to the drive rollers 146.

The control system for pneumatic air supplied to the drive motors 122 and 124 may also include an autostroke function that senses reductions in air flow to each of the drive motors during forward operation, which are indicative of increased resistance to lance movement, and automatically stops, reverses and reapplies forward direction air pressure to the motors to repetitively stop, withdraw and re-advance the flexible lances in the event obstacles or restrictions are encountered and sensed within tubes being cleaned.

Many variations may be made to the apparatus 100. For example, the lower support wall 130 may alternatively be reduced in overall size such that the belt 142 may be easily removed over the support wall 130. In this case, the entire belt drive assembly will be cantilever supported entirely from the inner support wall 120 via spacer blocks 152 and the motor shafts 126 and 128. In such an alternative configuration, one or more support blocks (not shown) may be provided on the belt side access door (not shown) to provide added vertical support to the reduced size alternative support wall 130 when the access door is closed as during drive operation. In another variation, where additional traction is desired, a longer space between the drive rollers 146 and an increased number of guide and idler rollers may be provided. In the embodiment 100 shown there are four idler/guide roller sets. For greater traction applications, 5, 6 or 7 idler/guide roller sets may be utilized in such an embodiment along with longer drive belts.

The single piece top idler rollers 180 may be replaced with a series of three separate grooved idler rollers bearing supported on each of the idler axle shafts to reduce friction and allow relative motion between flex lances which can simplify synchronization of the set of 2 or 3 lances at the fully extended position and at the fully retracted position of the lances. Finally, polymer or composite materials may be substituted in place of metal components in the embodiments shown, as these embodiments are merely exemplary. Therefore, all such changes, alternatives and equivalents in accordance with the features and benefits described herein, are within the scope of the present disclosure. Such changes and alternatives may be introduced without departing from the spirit and broad scope of this disclosure as defined by the claims below and their equivalents.

What is claimed is:

1. A flexible high pressure fluid cleaning lance drive apparatus comprising:

a first drive motor having a first drive shaft a second drive motor spaced from the first drive motor having a second drive shaft extending parallel to the first drive shaft;

an elongated cylindrical spline drive roller mounted on each of the first and second drive shafts;

a plurality of cylindrical guide rollers extending parallel to the spline drive rollers and spaced between the spline drive rollers;

an endless belt wrapped around the spline drive rollers and guide rollers, the belt having a transverse splined inner surface having splines shaped complementary to splines on the spline drive rollers; and a bias member supporting a plurality of follower rollers each aligned above one of the spline drive rollers and guide rollers, wherein the bias member is operable to press each follower roller toward one of the spline drive rollers and guide rollers to frictionally grip a flexible lance hose sandwiched between the follower rollers and the endless belt.

2. A flexible high pressure fluid cleaning lance drive apparatus comprising:

a housing;

at least one drive motor having a drive axle in the housing carrying a cylindrical spline drive roller;

a plurality of cylindrical guide rollers on fixed axles aligned parallel to the spline drive roller, and wherein a side surface of each guide roller and the at least one spline drive roller is tangent to a common plane between the rollers;

an endless belt wrapped around the at least one spline drive roller and guide rollers, the belt having a transverse splined inner surface having splines shaped complementary to splines on the spline drive roller; and a bias member supporting a plurality of follower rollers each aligned above one of the at least one spline drive roller and guide rollers, wherein the bias member is operable to press each follower roller toward one of the spline drive rollers and guide rollers to frictionally grip a flexible lance hose when sandwiched between the follower rollers and the endless belt.

3. The apparatus according to claim 2 wherein the bias member includes a plurality of pneumatic cylinders fastened in the housing each having a piston connected to a follower roller support block supporting the plurality of follower rollers above the endless belt.

4. The apparatus according to claim 2 wherein the bias member has a fixed portion and a movable portion, the movable portion supporting the plurality of follower rollers each vertically above one of the guide or spline rollers.

5. The apparatus according to claim 4 wherein each follower roller has one end rotatably fastened to a first flat plate and a second end rotatably fastened to a second flat plate and wherein the first and second flat plates are fixed to a follower roller support block.

6. The apparatus according to claim 5 wherein the movable portion of the bias element includes at least one piston in a pneumatic cylinder fixed to the housing.

7. The apparatus according to claim 6 wherein the first and second flat plates are parallel and spaced above the endless belt.

8. The apparatus according to claim 2 further comprising a cylindrical tension roller mounted in the housing for maintaining a tension on the endless belt.

9. The apparatus according to claim 8 wherein the tension roller is mounted on an eccentric axle.

10. The apparatus according to claim 2 wherein the housing has a vertical inner wall extending between front and rear walls and between top and bottom walls and an outer vertical wall extending between the front and rear walls.

11. The apparatus according to claim 10 wherein the at least one drive motor is mounted to the vertical inner wall and the guide rollers are fastened to the outer vertical wall.

12. A flexible lance drive apparatus comprising:

a housing;

a first and a second drive motor disposed side by side and spaced apart in a first portion of the housing, each drive motor having a drive axle projecting across a second portion of the housing each carrying a cylindrical spline drive roller;

a plurality of cylindrical guide rollers on fixed axles spanning across the second portion of the housing between the spline drive rollers and aligned parallel to the spline rollers, and wherein a side surface of each guide roller and spline drive roller is tangent to a common plane between the spline rollers;

an endless belt wrapped around the spline drive rollers and guide rollers, the belt having a transverse splined inner surface having splines shaped complementary to splines on the spline drive rollers; and a bias member supporting a plurality of follower rollers each aligned vertically above one of the spline drive rollers and guide rollers, wherein the bias member is operable to press each follower roller toward one of the spline drive rollers and guide rollers to frictionally grip a flexible lance hose sandwiched between the follower rollers and the endless belt.

13. The apparatus according to claim 12 wherein the bias member includes a plurality of pneumatic cylinders fastened in the housing each having a piston connected to a follower roller support block supporting the plurality of follower rollers above the endless belt.

14. The apparatus according to claim 12 wherein each follower roller has spaced concave curved grooves.

15. The apparatus according to claim 14 wherein each follower roller has one end rotatably fastened to a first flat plate and a second end rotatably fastened to a second flat plate and wherein the first and second flat plates are fixed to a follower roller support block.

16. The apparatus according to claim 15 wherein the bias member includes at least one piston in a pneumatic cylinder fixed to the housing.

17. The apparatus according to claim 15 wherein the first and second flat plates are parallel and spaced above the endless belt.

18. The apparatus according to claim 12 further comprising a cylindrical tension roller mounted in the second portion of the housing between the spline rollers for maintaining a tension on the endless belt.

19. The apparatus according to claim 18 wherein the tension roller is mounted on an eccentric axle adjustably fastened to a lower outer vertical wall in the second portion.

20. The apparatus according to claim 18 wherein the guide rollers and the tension roller are each fastened to the lower outer vertical wall in the second portion.

* * * * *